US006279243B1

(12) United States Patent
Tranås

(10) Patent No.: US 6,279,243 B1
(45) **Date of Patent: *Aug. 28, 2001**

(54) APPARATUS FOR INDICATING CORRECT OR FAULTY BACK POSTURE

(76) Inventor: Randi Henden Tranås, Nordahl Griegs veg 3c, N-7800 Namsos (NO)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/425,465

(22) Filed: Oct. 22, 1999

Related U.S. Application Data

(63) Continuation of application No. 08/801,304, filed as application No. PCT/NO95/00150 on Sep. 5, 1995.

(30) Foreign Application Priority Data

Sep. 6, 1994 (NO) ..... 943292

(51) Int. Cl.[7] ..... G01L 9/00; G01L 9/10

(52) U.S. Cl. ..... 33/512; 33/365; 33/391; 116/215

(58) Field of Search ..... 33/365, 366, 511, 33/512, 514.2, 370, 390, 391, 347, 371, 372; 116/200, 215, 67 R; 482/10; 273/DIG. 17; 434/247; 473/208, 211

(56) References Cited

U.S. PATENT DOCUMENTS

| | | | | |
|---|---|---|---|---|
| 2,191,683 | * | 2/1940 | Roberts | 116/215 |
| 2,357,746 | * | 9/1944 | Kuss | 482/10 |
| 2,494,278 | * | 1/1950 | Badovinac | 33/365 |
| 2,673,544 | * | 3/1954 | Erickson | 116/215 |
| 3,025,064 | * | 3/1962 | Flood | 473/211 |
| 3,063,721 | * | 11/1962 | Jackson et al. | 116/215 |
| 3,098,316 | * | 7/1963 | McCarthy | 273/DIG. 17 |
| 3,229,903 | * | 1/1966 | Smith | 116/215 |
| 3,429,052 | * | 2/1969 | Hembd et al. | 33/368 |
| 3,522,701 | * | 8/1970 | Perry | 116/67 R |
| 3,528,664 | * | 9/1970 | Gunn, Jr. | 116/215 |
| 3,703,878 | * | 11/1972 | Badovinac | 116/67 R |
| 4,196,524 | * | 4/1980 | Bechtel | 33/371 |
| 4,514,908 | * | 5/1985 | Yamaguchi | 33/365 |
| 4,829,676 | * | 5/1989 | Waldron | 33/372 |
| 4,972,595 | * | 11/1990 | Shimamura et al. | 33/366 |
| 5,005,835 | * | 4/1991 | Huffman | 273/DIG. 17 |
| 5,157,842 | * | 10/1992 | Swanda | 33/365 |
| 5,168,264 | * | 12/1992 | Agustin | 340/573 |
| 5,398,422 | * | 3/1995 | Clarkson | 33/365 |

FOREIGN PATENT DOCUMENTS

| | | | |
|---|---|---|---|
| 171349 | * | 11/1992 | (NO) . |
| 1648-514 | * | 5/1991 | (SU) . |

* cited by examiner

*Primary Examiner*—Andrew H. Hirshfeld
(74) *Attorney, Agent, or Firm*—Hunton & Williams

(57) ABSTRACT

The invention relates to a device (1) for placing on a person's head (2) to indicate correct or incorrect upright posture during the performance of various activities in a standing or sitting position. The device comprises a balance element consisting of a fixed body (4) which is firmly secured to a headband or similar for attachment to the head (2), and a moveable body (5) which is translationally moveable relative to the fixed body (4), essentially in a plane parallel to or coincident with the main plane of the fixed body (4), whereby the moveable body (5) is designed to move translationally relative to the fixed body (4) when a certain degree of deviation from the correct head position occurs.

10 Claims, 3 Drawing Sheets

APPARATUS FOR INDICATING CORRECT OR FAULTY BACK POSTURE

This application is a Continuation of application Ser. No. 08/801,304, filed Feb. 18, 1997, now abandoned which is a 371 of PCT/NO95/00150, filed on Sep. 5, 1995, which application(s) are incorporated herein by reference.

THE FIELD OF THE INVENTION

The present invention relates to a device for placing on a person's head to indicate correct or incorrect upright posture during the performance of various activities in a standing or sitting position, comprising a balance element connected to a headband, a hairband, an ear clip or other appropriate means for attachment to a person's head.

BACKGROUND OF THE INVENTION

A device of this kind is taught in the applicant's own Norwegian Patent 171,349. This device consists of a balance body which is attached to a U-shaped band, which in turn is attached to a hairband or similar. A spring or similar is located between the legs of the U-band so that the balance body will tip forward when the head is moved too far forward and out of a correct head position. When this happens, a signal will be given to indicate that the user has assumed an incorrect sitting posture.

This device functions extremely well under qualified guidance, but nevertheless encumbered with certain weaknesses. For example, the device is rather large and lumpy and projects quite high above the user's head. This means that the device could easily be torn off the head if the user knocks into a low door frame or similar.

Further, the device has proven to be somewhat difficult to calibrate and is very sensitive to deviations from the correct calibration. Moreover, it is difficult for the user to perceive when the balance body of the device tips forward, and he or she is therefore dependent on either a mirror or having another person present as an observer.

Moreover, the device will only indicate incorrect head position when the head is tipped too far forward. It will not indicate an incorrect head position when the head is tipped sideways. SUMMARY OF THE INVENTION In order to eliminate these disadvantages it is therefore proposed to design the device as described in the characterising clause of independent claim I below, and also in the subsequent dependent claims.

BRIEF DESCRIPTION OF THE DRAWING

The device will be described in more detail below with reference to the accompanying drawings, wherein:

FIG. 6 shows the device from above and with the moveable body in a neutral position;

FIG. 7 shows a section along the line VII—VII in FIG. 6;

FIG. 8 shows the device from above with the moveable body displaced from the neutral position;

FIG. 9 shows a section along the line IX—IX in FIG. 8.

DETAILED DESCRIPTION OF THE EMBODIMENT

Figure 1:
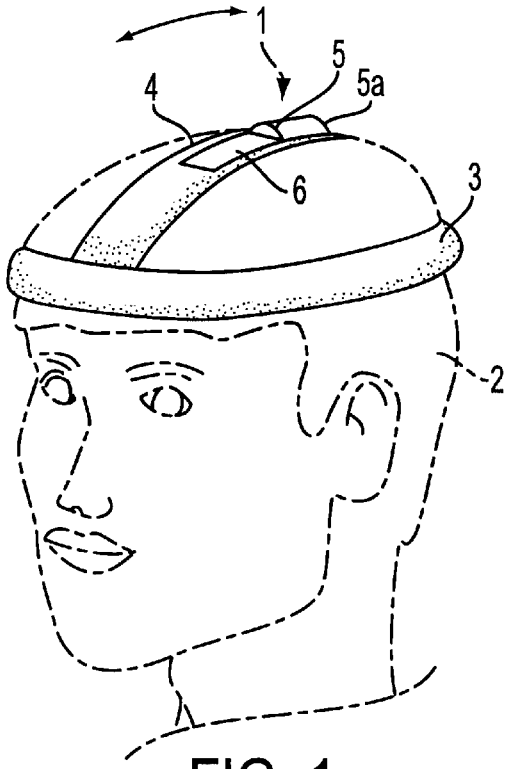
FIG. 1 illustrates a device where the moveable body is a slide which can move in a channel in the fixed body.

In FIG. 1, a device 1 is shown placed on a person's head 2 with the aid of an attachment means 3, which may be a hairband, a headband or another appropriate means. The device I consists of a fixed body 4, which is firmly secured to the attachment means 3, and a moveable body 5, which can move translationally relative to the fixed body 4.

In the exemplary embodiment according to FIG. 1, the moveable body 5 consists of a slide block 5*a* which is designed to move in a channel 6 in the fixed body 4. When the position of the head is correct, the block 5*a* will preferably be at the highest point of the head and preferably in the rear end of the channel 6. If the head is bent too far forward, the weight of the block 5*a* will overcome the frictional forces against the channel 6 and the block 5*a* will move forward in the channel 6. The materials and design of the block 5*a* and the fixed body can be chosen so that an audible sound is made when the block 5*a* strikes the end of the channel 6.

Figure 2:
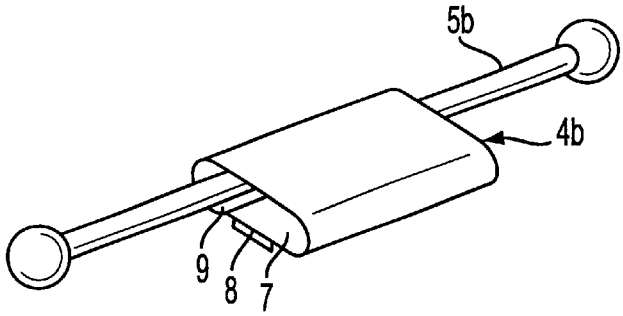
FIG. 2 shows a device where the moveable body is a pin which, when the head s position is incorrect, will move out of a recess in the fixed body.
Figure 3A:
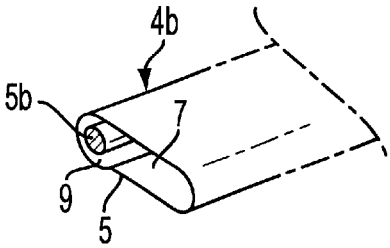
FIGS. 3*a* and 3*b* show the movement of the moveable body according to FIG. 2.
Figure 3B:
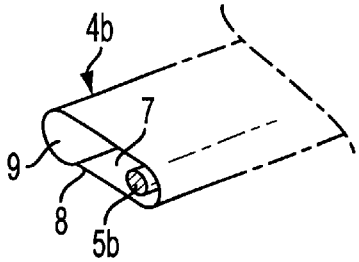

In FIG. 2, a second embodiment of the device is shown. Here, the moveable body 5 consists of a pin 5*b* and the fixed body consists of a holder 4*b* equipped with a through-going slot 7 which defines a plane 8 having a recess 9 at the rear end thereof. When the position of the head is correct, the pin 5*b* is in the recess 9, but when the head is tipped too far forward, it will roll out of the recess 9 and down the plane 8 and preferably make an audible sound when it strikes against the end of the holder 4*b*. FIGS. 3*a* and 3*b* show the position of the pin 5*b* when the position of the head is correct and incorrect, respectively.

Figure 4:
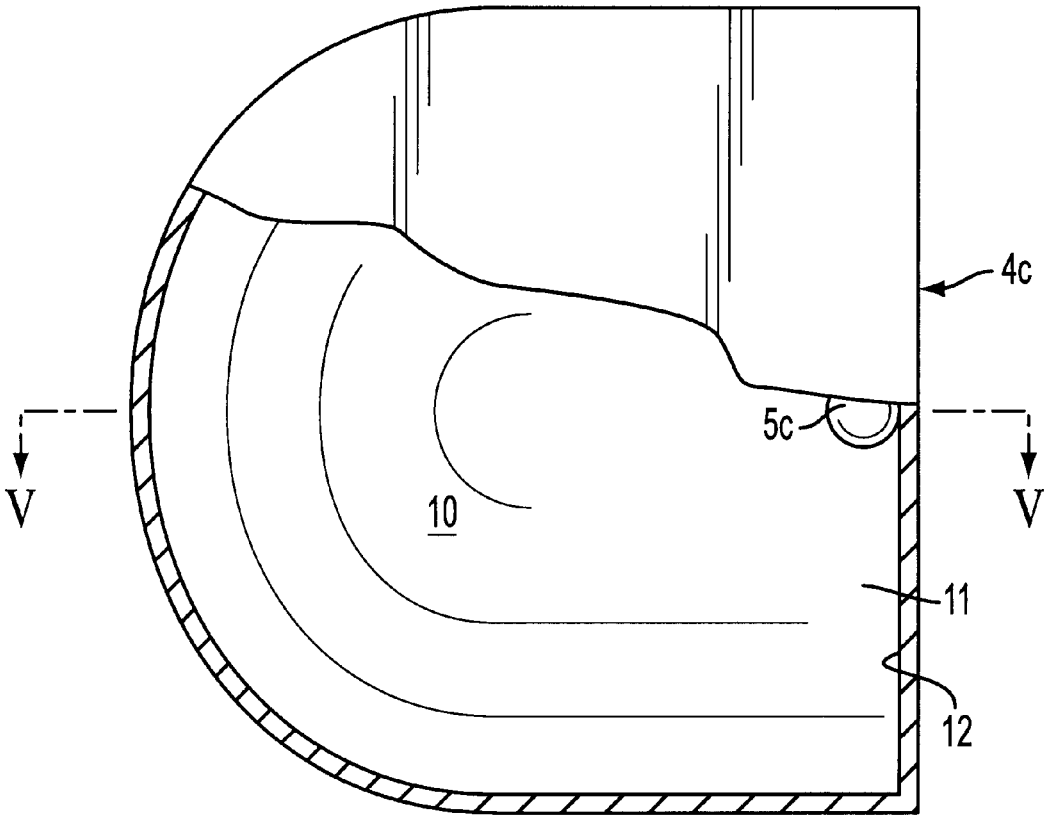
FIG. 4 illustrates a device where the moveable body is a ball which will roll along an inclined plane when the head position is incorrect.
Figure 5:
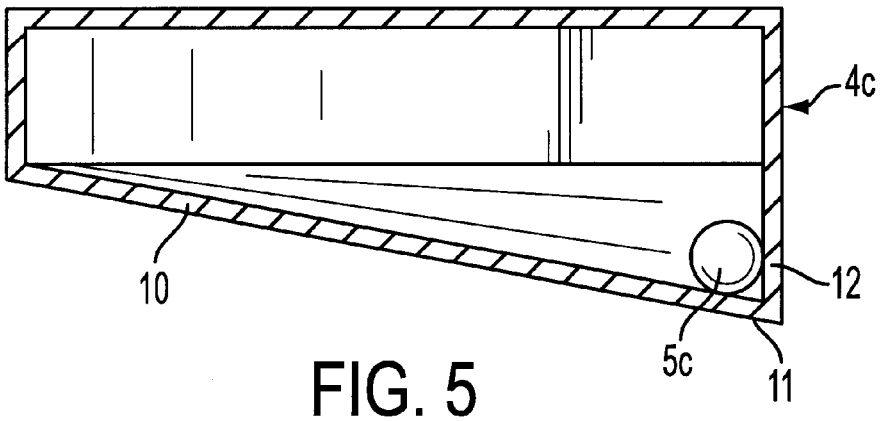
FIG. 5 shows a section through the device in FIG. 4 along the line V—V.
Figure 8:
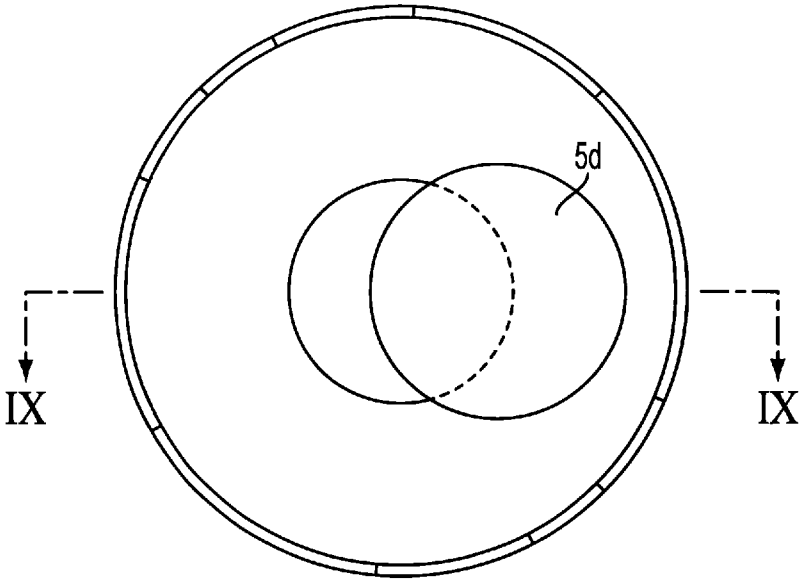
FIGS. 6–9 show a moveable body made of a disc which is designed to move in a hole in the fixed body.
Figure 9:
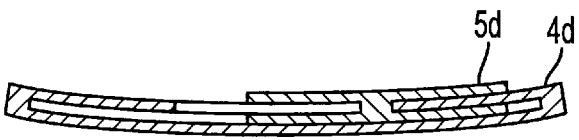
Figure 6:
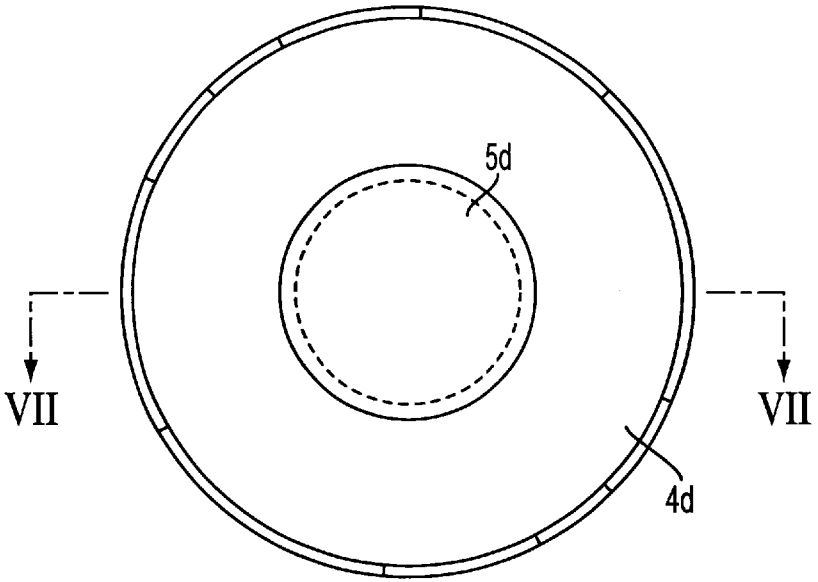
Figure 7:
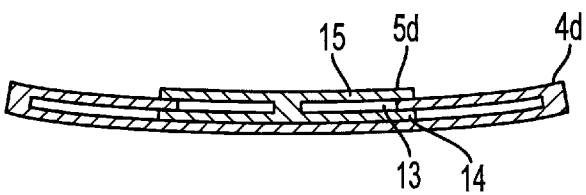

An embodiment is shown in FIG. 4 where the moveable body consists of a ball 5*c* and the fixed body of a box 4*c*. The box 4*c* is equipped with an inclined plane 10 which is preferably curved in such a way that it inclines from the edges of the box and down towards a bottom point 11 at the back edge 12 of the box. In the neutral position, the ball 5*c* will be at the lowest point 11 of the inclined plane. When the head is tipped too far forward or perhaps to the side, the inclined plane will move past the horizontal position and the lowest point II will thereby come to be higher than the inclined plane at the opposite end thereof. The ball will thus roll down the inclined plane and strike against the box wall, preferably making an audible sound in doing so. The box 4*c* is preferably closed so that the ball 5*c* is prevented from falling out. The box 4*c* is attached in an appropriate manner to a headband or similar.

FIGS. 6–9 show a fourth embodiment where the moveable body consists of a disc 5*d* and the fixed body consists similarly of a disc 4*d* of greater diameter. As can best be seen in FIG. 7, the disc 4*d* is double and in one wall has a hole 13 of a smaller diameter than the diameter of the disc 5*d*. Said disc 5*d* is also double, but the walls in this case are only connected in the centre of the disc. The disc 5*d* is placed in the hole 13 so that one of the walls 14 of the disc 5*d* is on the inside of (or behind) the edge of the hole, whilst the other wall 15 is on the outside. When the position of the head is correct, the disc 5*d* is centred in the hole 13. On deviation from the correct head position, the disc 5*d* will shift relative to the hole 13 and clearly indicate that the head position is incorrect. Also in this case, an audible sound will preferably be made when the disc 5*d* reaches its outermost position. Both the disc 5*d* and the disc 4*d* are preferably double curved, so that the device is less sensitive to movement. The curve can be varied according to the desired degree of sensitivity.

In an embodiment that is not illustrated, the moveable body may consist of a mercury ball or similar which on deviation from the correct head position moves in such a way that it closes an electronic circuit. The electronic circuit may be formed so that it emits an audible sound, e.g., a piping sound, actuates a vibration device, gives a light signal or in another manner indicates that an incorrect head position has been assumed.

The device may also be equipped with a proximity sensor which detects the position of the moveable body and gives a continuous or stepwise signal dependent on the position.

What is claimed is:

1. An indicator device for indicating correct and incorrect head positions of a person's head, comprising:

a base which fits onto the person's head;

a housing attached to the base, the housing comprising a top wall, a sloped bottom wall, and a side wall, the bottom wall comprising a first end, a second end, and at least two side edges, the first end being at a lower position than the second end;

an indicator body enclosed and retained in the housing, the indicator body being moveable in a plurality of directions from a start position, the start position of the indicator body corresponding to the correct head position of the person's head and wherein the start position is lower than the at least two side edges and located at the first end between the at least two side edges; and wherein when the person's head is deviated from the correct head position to the incorrect head position, the indicator is deviated in a direction corresponding to a direction from the correct head position to the incorrect head position of the person's head, and the indicator body moves from the start position to one of the plurality of directions and strikes the side wall of the housing causing an audible signal to indicate the incorrect head position.

2. The device according to claim 1, wherein the indicator body is a ball, and the bottom wall comprises a plurality of inclined planes, the inclined planes having a coincident lowest point, wherein the ball is at the lowest point of the plurality of inclined planes when the person's head is in the correct head position.

3. The device according to claim 1, wherein the housing has a substantially U-shape.

4. A method of indicating correct and incorrect head positions, comprising:

fitting a base of an indicator onto a person's head;

placing the person's head in the correct head position, the indicator comprising an enclosed indicator body moveable in a plurality of directions from a start position, the start position of the indicator body corresponding to the correct head position of the person's head, the indicator body enclosed and retained by a top wall, a sloped bottom wall, and a side wall of the indicator, the bottom wall comprising a first end, a second end, and at least two side edges, the first end being at a lower position than the second end and wherein the start position is lower than the at least two side edges and located at the first end between the at least two side edges;

deviating the person's head from the correct head position to the incorrect head position;

deviating the indicator in a direction corresponding to a direction from the correct head position to the incorrect head position of the person's head;

moving the indicator body in one of the plurality of directions from the start position; and indicating the deviation of the indicator and the incorrect head position by striking the indicator body on the side wall of the indicator causing an audible signal.

5. An indicator device for indicating correct and incorrect head positions of a person's head, comprising:

a base which fits onto the person's head;

a housing attached to the base, the housing comprising a top wall, a bottom wall, and a side wall;

an indicator body enclosed and retained in the housing, the indicator body being moveable in a plurality of directions from a start position, the start position of the indicator body corresponding to the correct head position of the person's head, said plurality of directions being limited to all angles within one-hundred-eighty (180) degrees from the start position, wherein contact of the indicator body with the side wall from any one of said plurality of directions from the start position causes an audible signal and wherein the indicator body is movable in any direction and any angle after moving from the start position in a direction away from the side wall; and wherein when the person's head is deviated from the correct head position to the incorrect head position, the indicator is deviated in a direction corresponding to a direction from the correct head position to the incorrect head position of the person's head, and the indicator body moves from the start position to one of the plurality of directions and strikes the side wall of the housing causing the audible signal to indicate the incorrect head position.

6. The device according to claim 5, wherein the indicator body is a ball, and the bottom wall comprises a plurality of inclined planes, the inclined planes having a coincident lowest point, wherein the ball is at the lowest point of the plurality of inclined planes when the person's head is in the correct head position.

7. The device according to claim 5, wherein the housing has a substantially U-shape.

8. A method of indicating correct and incorrect head positions, comprising:

fitting a base of an indicator onto a person's head;

placing the person's head in the correct head position, the indicator comprising an enclosed indicator body moveable in a plurality of directions from a start position, said plurality of directions being limited to all angles within one-hundred-eighty (180) degrees from the start position, the start position of the indicator body corresponding to the correct head position of the person's head, the indicator body being enclosed and retained by a top wall, a bottom wall, and a side wall of the indicator wherein contact of the indicator body with the side wall from any one of said plurality of directions from the start position causes an audible signal and wherein the indicator body is movable in any direction and any angle after moving from the start position in a direction away from the side wall;

deviating the person's head from the correct head position to the incorrect head position;

deviating the indicator in a direction corresponding to a direction from the correct head position to the incorrect head position of the person's head;

moving the indicator body in one of the plurality of directions from the start position; and indicating the deviation of the indicator and the incorrect head position by striking the indicator body on the side wall of the indicator causing the audible signal.

9. A device for placing on a person's head to indicate correct or incorrect upright posture during performance of various activities in a standing or sitting position, comprising:

a basis for attachment to the person's head;

an inclination indicator connected to said basis, the inclination indicator having a basic body firmly secured to the basis, and an indicator body moveable in a plurality of directions from a start position, the start position indicating correct head position, relative to the basic body, essentially on a surface essentially coincident with a horizontal plane, whereby the indicator body is moveable relative to the basic body when a certain degree of deviation from the correct head position occurs and returns to the start position when the correct head position is once more assumed;

wherein the indicator body is a disc, the basic body defining a hole which has a slightly smaller diameter than the disc, and the disc at least in part being behind an edge of the hole and being moveable relative to the hole when a position of the head varies; and wherein the disc is designed to shift in all directions in a main plane of the basic body.

10. A device for placing on a person's head to indicate correct or incorrect upright posture during performance of various activities in a standing or sitting position, comprising:

a basis for attachment to the person's head;

an inclination indicator connected to said basis, the inclination indicator having a basic body firmly secured to the basis, and an indicator body moveable in a plurality of directions from a start position, the start position indicating correct head position, relative to the basic body, essentially on a surface essentially coincident with a horizontal plane, whereby the indicator body is moveable relative to the basic body when a certain degree of deviation from the correct head position occurs and returns to the start position when the correct head position is once more assumed;

wherein the indicator body is a disc, the basic body defining a hole which has a slightly smaller diameter than the disc, and the disc at least in part being behind an edge of the hole and being moveable relative to the hole when a position of the head varies; and wherein the basic body and the disc are curved with corresponding radius or curvature.

* * * * *